US005261971A

United States Patent [19]

Yoshitomi et al.

[11] Patent Number: 5,261,971

[45] Date of Patent: Nov. 16, 1993

[54] PROCESS FOR PREPARATION OF GRAIN-ORIENTED ELECTRICAL STEEL SHEET HAVING SUPERIOR MAGNETIC PROPERTIES

[75] Inventors: Yasunari Yoshitomi, Kitakyushu; Takehide Senuma, Sagamihara; Yozo Suga; Nobuyuki Takahashi, both of Kitakyushu, all of Japan

[73] Assignee: Nippon Steel Corporation, Tokyo, Japan

[21] Appl. No.: 869,857

[22] Filed: Apr. 16, 1992

Related U.S. Application Data

[63] Continuation of Ser. No. 507,959, Apr. 11, 1990.

[30] Foreign Application Priority Data

Apr. 14, 1989 [JP] Japan ..... 1-94412
Apr. 14, 1989 [JP] Japan ..... 1-94413

[51] Int. Cl.[5] ..... C21D 8/12
[52] U.S. Cl. ..... 148/111; 148/112
[58] Field of Search ..... 148/111, 112, 113

[56] References Cited

U.S. PATENT DOCUMENTS 4,473,416 9/1984 Kawamo et al. ..... 148/111
5,039,359 8/1991 Yoshitomi et al. ..... 148/112

FOREIGN PATENT DOCUMENTS 0098324 1/1984 European Pat. Off. .
0219611 4/1987 European Pat. Off. .
40-15644 7/1965 Japan .
51-20716 2/1976 Japan .
51-13469 4/1976 Japan .
52-24116 2/1977 Japan .
54-24685 8/1979 Japan .
57-89433 6/1982 Japan .
57-158322 9/1982 Japan .
59-56522 4/1984 Japan .
59-32526 8/1984 Japan .
59-34212 8/1984 Japan .
59-35415 8/1984 Japan .
59-190324 10/1984 Japan .
60-37172 8/1985 Japan .
2016987 9/1979 United Kingdom .
2095287 9/1982 United Kingdom .
2130241 5/1984 United Kingdom .

*Primary Examiner*—George Wyszomierski
*Attorney, Agent, or Firm*—Kenyon & Kenyon

[57] ABSTRACT

A silicon steel slab comprising 0.05 to 0.8% by weight of Mn and up to 0.014% by weight of S+0.405Se is heated at a temperature lower than 1280° C. and hot-rolled under such conditions that the hot rolling-finish temperature is 700° to 1150° C., the cumulative reduction ratio at the final three passes is at least 40%, and the reduction ratio at the final pass is at least 20%, or this silicon steel slab is hot-rolled at a hot rolling-finish temperature of 750° to 1150° C. while adopting the above-mentioned reduction ratio according to need, is maintained at a temperature not lower than 700° C. for at least 1 second, and wound at a winding temperature lower than 700° C. The hot-rolled sheet is subjected to the hot-rolled sheet annealing, finally cold-rolled at a reduction ratio of at least 80%, subjected to the decarburization annealing, and then subjected to the final finish annealing. According to this process, a grain-oriented electrical steel sheet having superior magnetic properties is obtained.

6 Claims, 12 Drawing Sheets

HOT ROLLING CONDITION : (A)
RECRYSTALLIZATION RATIO (POINT OF 1/4 THICKNESS):92%

HOT ROLLING CONDITION : (B)
RECRYSTALLIZATION RATIO (POINT OF 1/4 THICKNESS):23%

HOT ROLLING CONDITION : (A)

HOT ROLLING CONDITION : (B)

HEAT TREATMENT CONDITION:(C)
RECRYSTALLIZATION
RATIO (POINT OF
1/4 THICKNESS):68%

HEAT TREATMENT CONDITION : (D)
RECRYSTALLIZATION
RATIO (POINT OF
1/4 THICKNESS):18%

HEAT TREATMENT CONDITION : (E)
RECRYSTALLIZATION
RATIO (POINT OF
1/4 THICKNESS):100%

HEAT TREATMENT CONDITION : (F)
RECRYSTALLIZATION
RATIO (POINT OF
1/4 THICKNESS):35%

ROLLING CONDITION:(E)

ROLLING CONDITION:(F)

PROCESS FOR PREPARATION OF GRAIN-ORIENTED ELECTRICAL STEEL SHEET HAVING SUPERIOR MAGNETIC PROPERTIES

This application is a continuation, of application Ser. No. 07/507,959 filed Apr. 11, 1990.

BACKGROUND OF THE INVENTION

1. Field of the Invention

A grain-oriented electrical steel sheet is used as a core material for electric devices such as a transformer and this grain-oriented electrical steel sheet should have superior magnetic properties such as exciting characteristics and core loss characteristics. The magnetic flux density $B_8$ at a magnetic field intensity of 800 A/m is generally used as the numerical value representing the exciting characteristics, and the core loss $W_{17/50}$ per kg observed when the sheet is magnetized to 1.7 Tesla (T) at a frequency of 50 Hz is used as the numerical value representing the core loss characteristics. The magnetic flux density is a factor having the most influence on the core loss characteristics, and in general, the higher the magnetic flux density, the better the core loss characteristics. Nevertheless, an increase of the magnetic flux density generally results in an increase of the size of secondary recrystallized grains, and sometimes the core loss characteristics are lowered. In contrast, the core loss characteristics can be improved, regardless of the size of the secondary recrystallized grains, by controlling the magnetic domain.

This grain-oriented electrical steel sheet is prepared by a secondary recrystallization at the final finish annealing step, to develop the Goss structure in which a {110} plane is formed on the surface of the steel sheet and a <001> axis is produced in the rolling direction.

To obtain good magnetic characteristics, the easy magnetization axis <001> must be arranged precisely in line with the rolling direction.

Typical instances of this process for the preparation of a grain-oriented electrical steel sheet having a high magnetic flux density are disclosed in Japanese Examined Patent Publication No. 40-15644 to Satoru Taguchi et al, and Japanese Examined Patent Publication No. 51-13469 to Takuichi Imanaka et al. In the former process, MnS and AlN are used as the main inhibitor, and in the latter process, MnS, MnSe and Sb are used as the main inhibitor. Therefore, according to the presently available technique, the size, shape and dispersion state of precipitates acting as the inhibitor must be controlled. For example, in connection with the MnS, a method is adopted in which MnS is once solid-dissolved at the step of heating a slab before hot rolling and MnS is precipitated at the hot rolling step. A temperature of about 1400° C. is necessary for completely solid-dissolving MnS in an amount necessary for the secondary recrystallization, and this temperature is higher by more than 200° C. than the slab-heating temperature adopted for a usual steel. This high-temperature slab-heating treatment has the following disadvantages.

(1) A high-temperature slab-heating furnace exclusively used for the production of a grain-oriented electrical steel sheet is necessary.

(2) The energy unit of the heating furnace is high.

(3) The amount of melted scale is increased, and the operation efficiency is reduced by a drain-off of the slag.

These disadvantages will be overcome if the slab-heating temperature is lowered to the level adopted for a usual steel, but this means that the amount of MnS effective as the inhibitor must be reduced or MnS not used at all, which results in an unstable secondary recrystallization. Accordingly, to realize a low-temperature heating of the slab, the inhibitor must be intensified by precipitates other than MnS, by one means or another and the growth of normal grains at the finish annealing properly controlled. As such an inhibitor, sulfides, nitrides, oxides, and grain boundary-precipitated elements are considered to be effective, and for example, the following known techniques can be mentioned.

Japanese Examined Patent Publication No. 54-24685 discloses a method in which the slab-heating temperature is adjusted to 1050° to 1350° C. by incorporating into a steel a grain boundary-segmented element such as As, Bi, Sn or Sb, and Japanese Unexamined Patent Publication No. 52-24116 discloses a method in which the slab-heating temperature is adjusted to 1100° to 1260° C. by incorporating a nitride-forming element such as Al, Zr, Ti, B, Nb, Ta, V, Cr or Mo. Furthermore, Japanese Unexamined Patent Publication No. 57-158322 discloses a technique of lowering the slab-heating temperature by reducing the Mn content and adjusting the Mn/S ratio to less than 2.5, and stabilizing the secondary recrystallization by an addition of Cu. Separately, a technique has been proposed of improving the metal structure in combination with the intensification of the inhibitor. Namely, Japanese Unexamined Patent Publication No. 57-89433 discloses a method in which a low-temperature heating of a slab at 1100° to 1250° C. is realized by incorporating an element such as S, Se, Sb, Bi, Pb, Sn or B in addition to Mn, and simultaneously, controlling the columnar crystal ratio in the slab and the reduction ratio at the second cold rolling step. Furthermore, Japanese Unexamined Patent Publication No. 59-190324 proposes a technique of stabilizing the secondary recrystallization by incorporating S and Se, forming an inhibitor mainly by Al, B and nitrogen, and carrying out a pulse annealing at the primary recrystallization annealing conducted after cold rolling.

The present inventors previously proposed a technique of realizing a low-temperature heating of a slab by controlling the Mn content to 0.08 to 0.45% and the S content to less than 0.007%, in Japanese Unexamined Patent Publication No. 59-56522. According to this method, the problem of an insufficient linear secondary recrystallization in a product, which is due to a coarsening of the crystal grains of the slab during the high-temperature heating of the slab, can be solved.

The primary object of this low-temperature slab-heating method is to reduce the manufacturing cost, but the method cannot be industrialized unless good magnetic properties can be stably obtained. If the slab-heating temperature is lowered, changes at the hot rolling step, such as lowering of the hot rolling, should naturally be made, but the continuous production process comprising a low-temperature heating of a slab, including the hot rolling step, has not been investigated.

In the conventional high-temperature slab-heating (for example, at a temperature higher than 1300° C.), the main roles of hot rolling are the following three rolls, that is, (1) a division of coarse crystal grains by recrystallization, (2) a precipitation of fine MnS and AlN or control of the precipitation, and (3) a formation of {110}<001> oriented grains by shear deformation. In the low-temperature heating of the slab, the role (1) is not necessary, and the role (2) is sufficiently exerted if an appropriate microstructure is produced after decarburization annealing, as taught by in Japanese Patent Application No. 1-1778, and therefore, a control of the precipitates in the hot-rolled sheet is not necessary. Accordingly, the restrictions of the conventional hot rolling method are moderated in the low-temperature heating of the slab.

Therefore, the inventors examined the hot rolling method in which, to control the secondary recrystallization, the microstructure of a hot-rolled steel sheet is rationalized to a high level not attainable by the conventional high-temperature slab-heating method. For example, in connection with metal-physical phenomena after the final pass of hot rolling, a precipitation of fine MnS and AlN or control of the precipitation is a most important control item in the conventional method, and other phenomena are not taken into consideration.

The inventors noted the recrystallization phenomenon after the final pass of the finish hot rolling, not taken into consideration in the conventional techniques, and examined the hot rolling method for obtaining a product having good and stable magnetic properties by utilizing this phenomenon for controlling the microstructure of a hot-rolled steel sheet in the preparation process in which the low-temperature heating of the slab is carried out as the premise step and the final high-reduction cold rolling is carried out at a reduction ratio of at least 80%.

In connection with a hot rolling of a grain-oriented electrical steel sheet, as the means for preventing an insufficient secondary recrystallization (formation of linear fine grains continuous in the rolling direction) caused by a coarsening growth of the crystal grains of the slab by a high-temperature heating of the slab, a method has been proposed in which coarse crystal grains are divided by recrystallization high-reduction rolling conducted at a hot rolling temperature of 960° to 1190° C. and a reduction ratio of at least 30% per pass (Japanese Examined Patent Publication No. 60-37172), and the formation of linear fine grains can be moderated by this method, but this method requires the high-temperature heating of the slab to be carried out as the premise operation.

In the low-temperature heating of the slab (lower than 1280° C.), the above-mentioned coarsening of crystal grains caused by the high-temperature heating of the slab is not caused, and therefore, the recrystallization high-reduction rolling for a division of coarse crystal grains is not necessary.

In connection with the preparation process using MnS, MnSe or Sb as the inhibitor, a method has been proposed in which hot rolling is continuously carried out at a reduction ratio of at least 10% at a hot rolling temperature of 950° to 1200° C., and then the hot-rolled product is cooled at a cooling rate of at least 3° C./sec to finely and uniformly precipitate MnS, MnSe or the like, whereby the magnetic properties are improved (Japanese Unexamined Patent Publication No. 51-20716). Furthermore, a method has been proposed in which the advance of the recrystallization is restrained by carrying out hot rolling at a low temperature, and the magnetic properties are improved by preventing a reduction of the {110}<001> oriented grains at the subsequent recrystallization (Japanese Examined Patent Publication No. 59-32526 and Japanese Examined Patent Publication No. 59-35415). Even in these methods, the preparation process in which the low-temperature heating of a slab is carried out as the premise operation and the high-reduction final cold rolling is carried out at a reduction ratio of at least 80% is not examined. Still further, in connection with hot rolling of a silicon steel slab having a carbon content lower than 0.02% by weight, a method has been proposed in which a low-temperature high reduction hot rolling, which results in an accumulation of strain in the hot-rolled sheet, is carried out, and at the subsequent annealing of the hot-rolled sheet, coarse crystal grains peculiarly formed in a steel having an especially low carbon content are divided by the recrystallization (Japanese Examined Publication No. 59-34212). But, according to this method, it is difficult to obtain good stable magnetic properties.

SUMMARY OF THE INVENTION

A primary object of the present invention is to obtain a grain-oriented electrical steel sheet stably by the method in which the low-temperature heating of a slab is carried out at a temperature lower than 1280° C. as the premise operation and the final cold rolling is carried out at a high reduction ratio of at least 80%.

According to the present invention, the recrystallization after the final pass of finish hot rolling, which has not been taken into consideration in the conventional methods, is utilized for attaining this object. Namely, for a silicon steel slab having an Mn content of 0.05 to 0.8% and an (S+0.405Se) content of up to 0.014%, the hot rolling-terminating temperature is adjusted and the hot tolling is carried out at a specific cumulative reduction ratio at final three passes, or the hot-rolled sheet is maintained at a predetermined temperature for a predetermined time after termination of the hot rolling and is then wound, whereby the recrystallization of the hot-rolled steel sheet is advanced and the strain in the hot-rolled steel sheet is reduced or the crystal grain diameter is made finer, and the hot-rolled steel sheet is cold-rolled and recrystallized and superior magnetic properties can be obtained.

More specifically, in accordance with the present invention, there is provided a process for the preparation of a grain-oriented electrical steel sheet, which comprises heating at a temperature lower than 1280° C. a slab comprising 0.021 to 0.075% by weight of C, 2.5 to 4.5% by weight of Si, 0.010 to 0.060% by weight of acid-soluble Al, 0.0030 to 0.0130% by weight of N, up to 0.014% by weight of S+0.405Se and 0.05 to 0.8% by weight of Mn, with the balance consisting of Fe and unavoidable impurities, hot-rolling the hot-rolled sheet, subsequently annealing the hot-rolled sheet according to need, subjecting the hot-rolled steel sheet to at least one cold rolling including final cold rolling at a reduction ratio of at least 80% and, if necessary, intermediate annealing, and subjecting the cold-rolled sheet to decarburization annealing and final finish annealing, wherein the hot rolling-terminating temperature is adjusted to 700° to 1150° C. and the cumulative reduction ratio at the final three passes of the hot rolling is adjusted to at least 40%. If the reduction ratio at the final pass of the finish hot rolling is adjusted to at least 20% in the above-mentioned process, a grain-oriented electrical steel sheet having greatly improved magnetic properties can be obtained.

On the other hand, in the above-mentioned process for the preparation of a grain-oriented electrical steel sheet, the hot rolling-terminating temperature is adjusted to 750 to 1150° C., the hot-rolled sheet is maintained at a temperature higher than 700° C. for at least 1 second after termination of the hot rolling, and the winding temperature is adjusted to a level lower than 700° C. In this process, if the cumulative reduction ratio at the final three passes of the finish hot rolling is adjusted to at least 40%, a grain-oriented electrical steel sheet having further superior magnetic properties can be obtained. Still further, if the reduction ratio at the final pass of the finish hot rolling is adjusted to at least 20% in the above-mentioned process, the magnetic properties are further improved in the obtained grain-oriented magnetic steel sheet.

DESCRIPTION OF THE PREFERRED EMBODIMENTS

The present invention will now be described in detail with reference to embodiments.

The method of controlling the cumulative reduction ratios at the final three passes (hereinafter referred to as "reduction ratio-adjusting method") will be first described with reference to experimental results.

Figure 1:
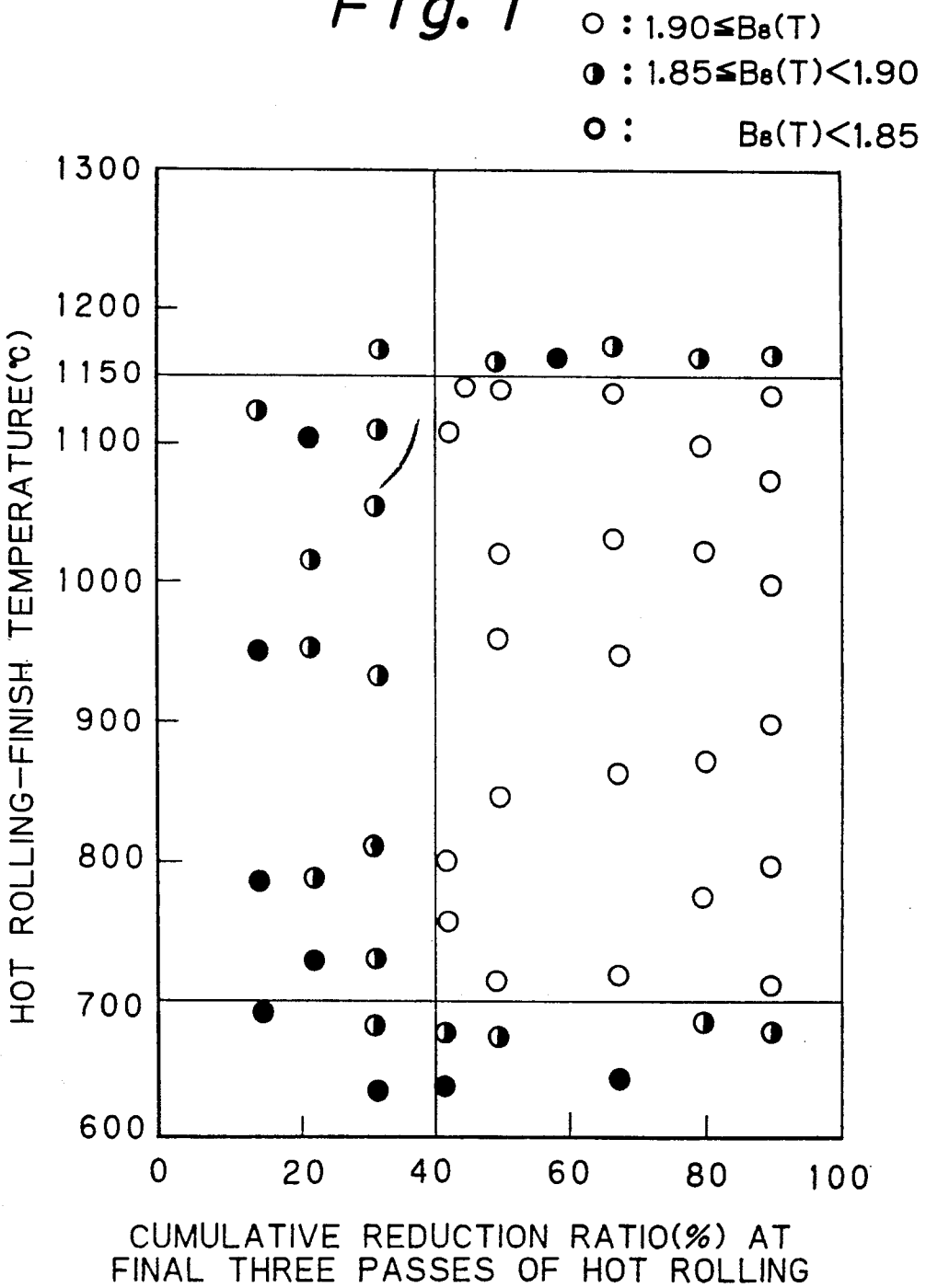
FIG. 1 is a graph showing the influences of the hot rolling-terminating temperature and the cumulative reduction ratio of the final three passes of the hot rolling on the magnetic flux density.

FIG. 1 shows the influences of the hot rolling-terminating temperature and the cumulative reduction ratio at the final three passes of the hot rolling on the magnetic flux density of a product. More specifically, a slab having a thickness of 20 to 60 mm and comprising 0.054% by weight of C, 3.27% by weight of Si, 0.029% by weight of acid-soluble Al, 0.0080% by weight of N, 0.007% by weight of S and 0.14% by weight of Mn, with the balance consisting of Fe and unavoidable impurities, was heated at 1100° to 1280° C., hot-rolled to a hot-rolled sheet having a thickness of 2.3 mm through 6 passes, and subjected to a winding simulation in which the hot-rolled sheet was water-cooled to 550° C. about 1 second after the hot rolling and maintained at 550° C. for 1 hour to effect furnace cooling. Then, the hot-rolled sheet was maintained at 1120° C. for 30 seconds, maintained at 900° C. for 30 seconds, and rapidly cooled to effect annealing of the hot-rolled sheet. Then, final high-reduction rolling was carried out at a reduction ratio of about 88% to obtain a cold-rolled sheet having a final thickness of 0.285 mm. Then a decarburization annealing was carried out at a temperature of 830° to 1000° C., an anneal separating agent composed mainly of MgO was coated on the cold-rolled sheet, and a final finish annealing was carried out.

As apparent from FIG. 1, it was found that, when the hot rolling-terminating temperature was 700° to 1150° C. and the cumulative reduction ratio at the final three passes was at least 40%, a high magnetic flux density of $B_8 \geqq 1.90T$ was obtained.

Figure 2:
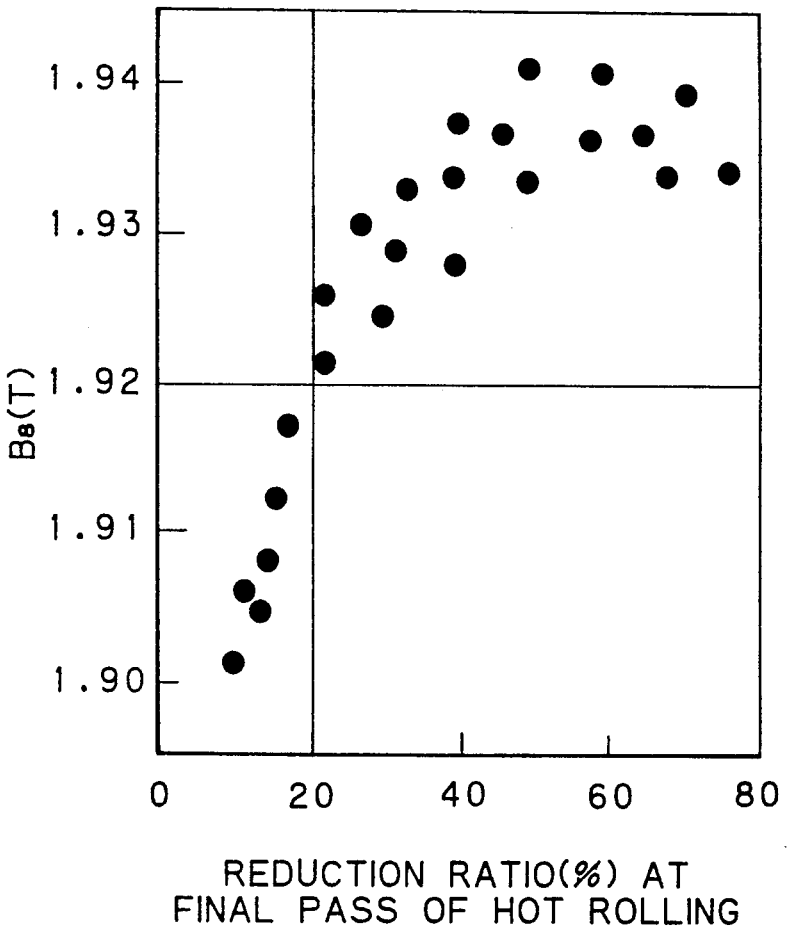
FIG. 2 is a graph illustrating the influences of the reduction ratio at the final pass of the hot rolling on the magnetic flux density of a product.

FIG. 2 is a graph illustrating the relationship between the reduction ratio at the final pass of the hot rolling and the magnetic flux density, observed in runs giving a high magnetic flux density in FIG. 1, where the hot rolling-terminating temperature was 700° to 1150° C. and the cumulative reduction ratio at the final three passes of the hot rolling was at least 40%.

As apparent from FIG. 2, it was found that, if the reduction ratio at the final pass was at least 20%, a high magnetic flux density of $B_8 \geqq 1.92T$ was obtained.

The reasons why the relationships shown in FIGS. 1 and 2 are established among the cumulative reduction ratio at the final three passes, the reduction ratio at the final pass, and the magnetic flux density of the product are not completely elucidated, but are assumed to be probably as follows.

Figure 3A:
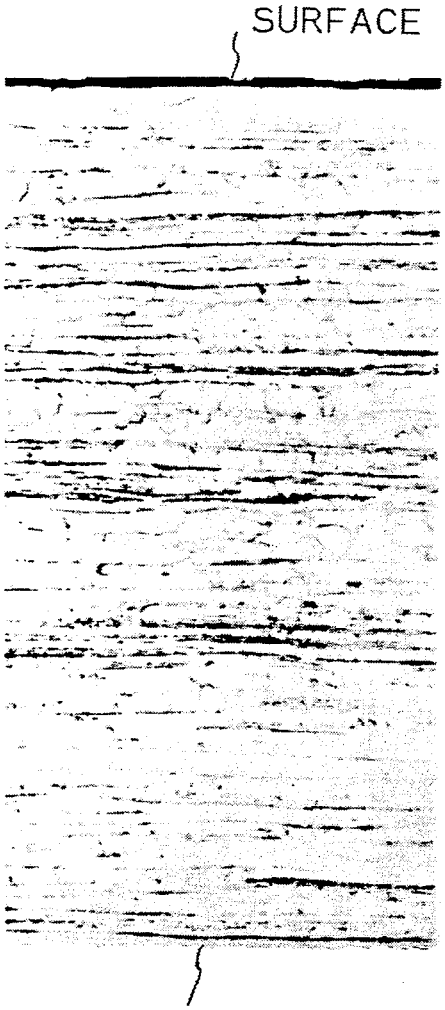
FIGS. 3-(*a*) and 3-(*b*) are metal microscope photos showing examples of microstructures of hot-rolled sheets obtained under different hot rolling conditions (A) and (B), respectively.
Figure 3B:
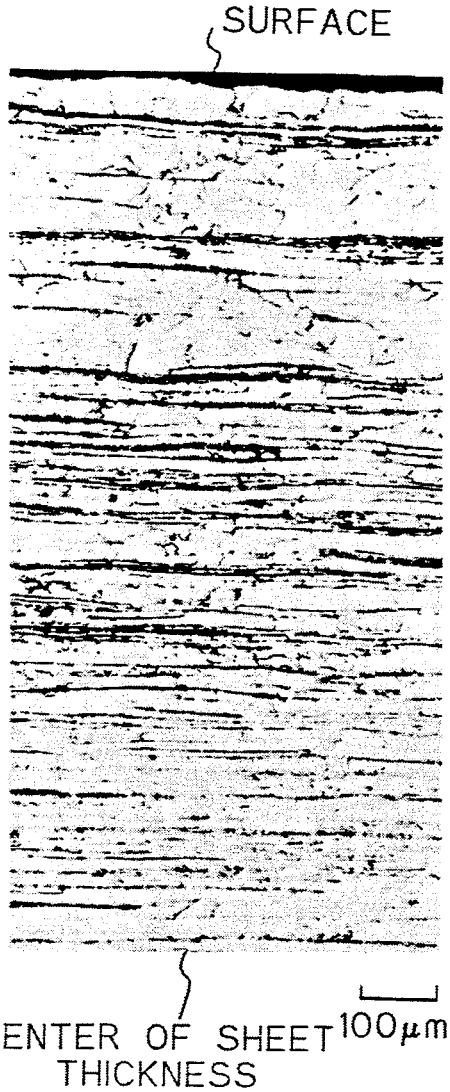
Figure 4:
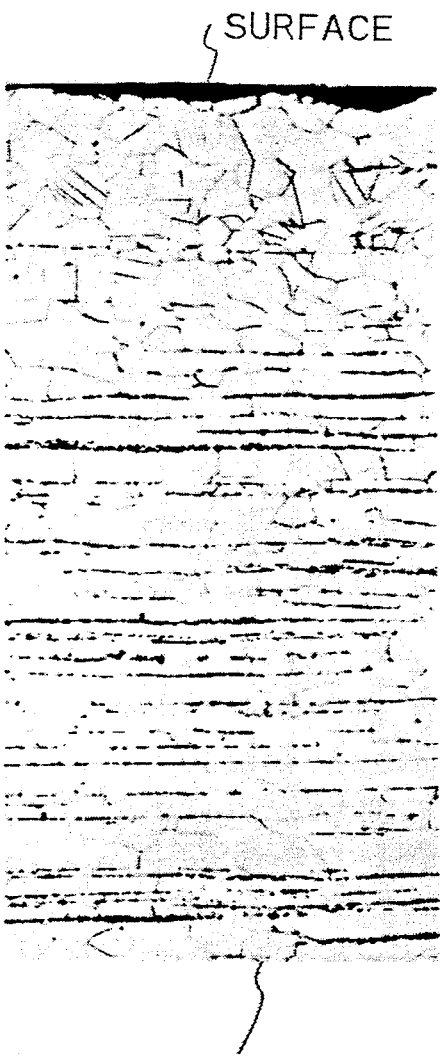
FIGS. 4-(*a*) and 4-(*b*) are metal microscope photos showing examples of microstructures of hot-rolled and annealed steel sheets obtained under different hot rolling conditions (A) and (B), respectively.
Figure 4:
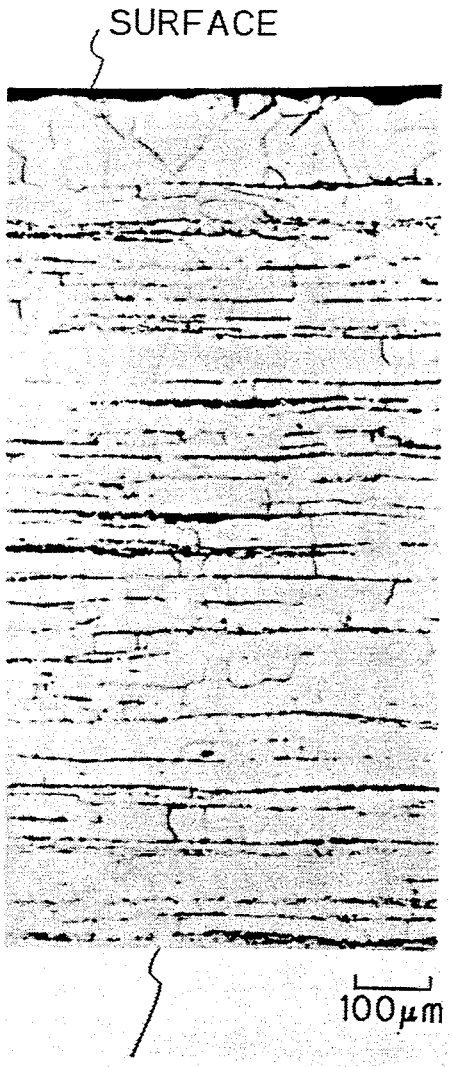
Figure 5:
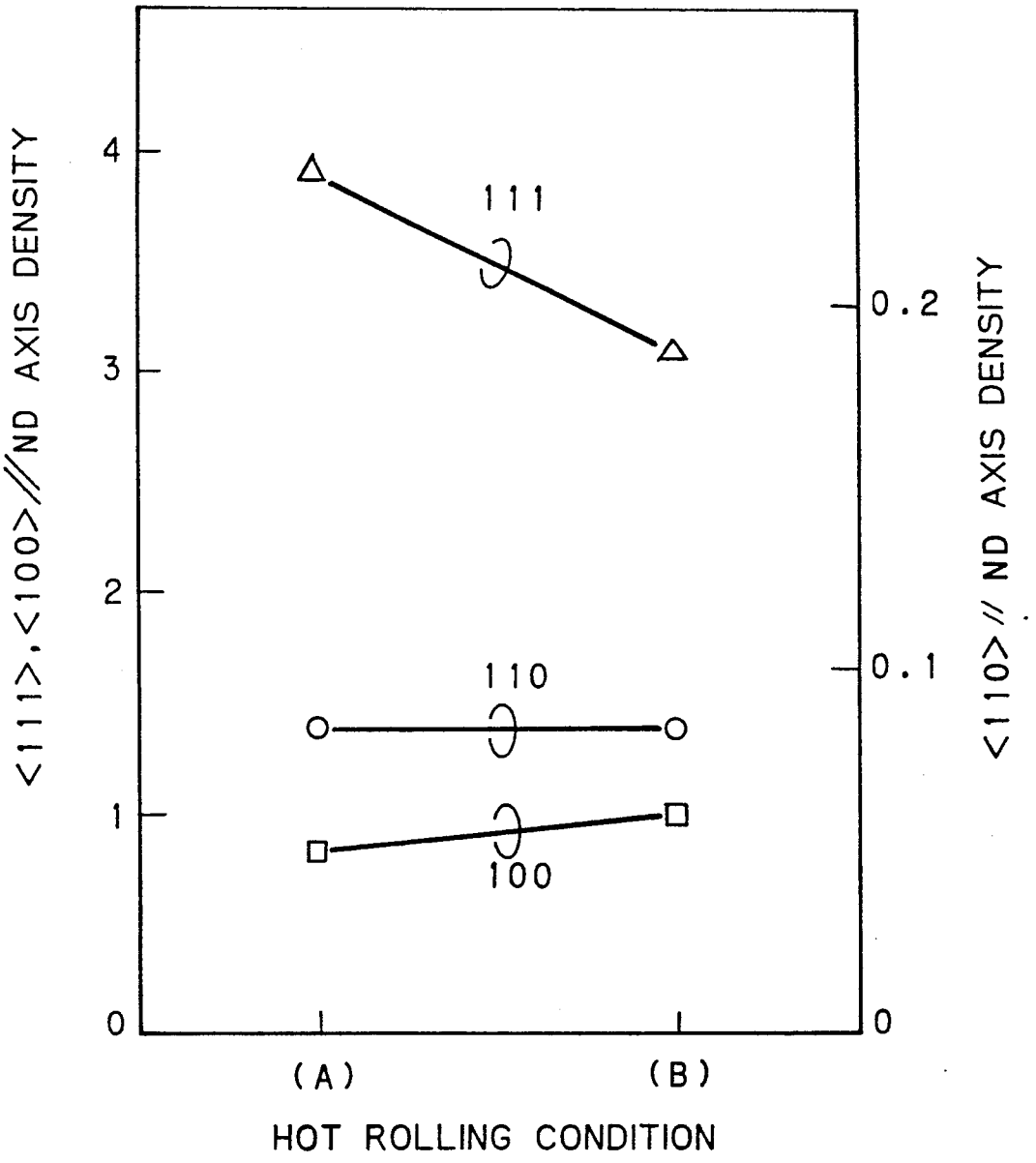
FIG. 5 is a graph showing textures of decarburized sheets obtained under different hot-rolling conditions (A) and (B)

FIGS. 3, 4, and 5 show examples of microstructures of hot-rolled steel sheets, microstructures of hot-rolled and annealed steel sheets, and textures (at the point of $\frac{1}{4}$ thickness), observed under different hot rolling conditions. More specifically, slabs having a thickness of 33.2 or 26 mm and the same composition as described above with respect to FIG. 1 were heated at 1150° C. and hot-rolled to form hot-rolled sheets having a thickness of 2.3 mm through a pass schedule of (A) 33.2 mm→18.6 mm→11.9 mm→8.6 mm→5.1 mm→3.2 mm→2.3 mm or (B) 26 mm→11.8 mm→6.7 mm→3.5 mm→3.0 mm→2.6 mm→2.3 mm. Then, the hot-rolled sheets were cooled under the same conditions as described above with respect to FIG. 1. The hot rolling-terminating temperature was (A) 925° C. or (B) 910° C., and the hot-rolled sheets were subjected to annealing and final high-reduction rolling to obtain cold-rolled steel sheets having a thickness of 0.285 mm. Then decarburization annealing was carried out by maintaining the cold-rolled steel sheets at 830° C. for 150 seconds in an atmosphere comprising 25% of $N_2$ and 75% of $H_2$ and having a dew point of 60° C.

As apparent from FIG. 3, in runs (A) satisfying the conditions of the present invention, the recrystallization of the hot-rolled sheet was much higher and the crystal grain diameter was smaller than in comparative runs (B). As apparent from FIG. 4, in runs (A) satisfying the conditions of the present invention, the crystal grain diameter after annealing of the hot-rolled sheet was smaller than in comparative runs (B). Furthermore, from FIG. 5 it is apparent that, in runs (A) satisfying the conditions of the present invention, the number of {111} oriented grains in the decarburized sheet was larger and the number of {100} oriented grains was smaller than in comparative runs (B), and there was no substantial difference in the number of {110} oriented grains.

Note, the recrystallization ratio (at the point of ¼ thickness) was measured by the method developed by the inventors for measuring the crystal strain by the image analysis of ECP (electron channelling pattern) [Collection of Outlines of Lectures Made at Autumn Meeting of Japanese Metal Association (November 1988), page 289], and the area ratio of low-strain grains having a higher sharpness than that of ECP obtained when an annealed sheet of a reference sample was cold-rolled at a reduction ratio of 1.5% was designated as the recrystallization ratio. According to this method, a much higher precision can be obtained than the precision attained by the conventional method of determining the recrystallization ratio by the naked eye observation of the microstructure.

As apparent from FIGS. 3, 4 and 5, in runs (A) satisfying the conditions of the present invention, the recrystallization ratio of the hot-rolled steel sheet was much higher (the strain was smaller), the crystal grain diameter in the hot-rolled steel sheet was smaller, the crystal grain diameter was smaller after annealing of the hot-rolled steel sheet than that in runs (B), and if the sheet was cold-rolled and then recrystallized, a texture in which the number of {111} oriented grains was larger and the number of {100} oriented grains was smaller than that in runs (B) was obtained without any influence on the number of {110} oriented grains.

It has been considered that the potential nucleus of {110}<001> secondary recrystallized crystal grains is formed by shearing deformation on the surface layer at the hot rolling, and that the method of coarsening the {100}<001> oriented crystal grains and keeping them in the strain-reduced state in the hot-rolled steel sheet is effective for enriching the {110}<001> oriented grains in the steel sheet after cold rolling and recrystallization. In the present invention, although the crystal grain diameter in the hot-rolled steel sheet is small, the crystal grains are kept in the strain-reduced state, and this tendency is maintained after the annealing of the hot-rolled steel sheet, and therefore, the number of the {110}<001> oriented grains in the steel sheet after the decarburization annealing is not influenced by the present invention hot-rolling method.

It is known that the main orientations {111}<112> and {100}<025> in the decarburized steel sheet are orientations having influences on the growth of {110}<001> secondary recrystallized crystal grains, and it is considered that the larger the number of {111}<112> oriented grains and the smaller the number of {100}<025> oriented grains, the easier reduction the growth of {110}<001> secondary recrystallized grains. In the present invention, by applying a high at final three passes of the hot rolling, the number of sites for formation of nuclei at the recrystallization subsequent to the final pass is increased, the recrystallization is advanced, and the crystal grains are made finer. If this hot-rolled steel sheet is subjected to the hot-rolled sheet annealing, many nuclei present in the hot-rolled sheet are changed to recrystallized grains, and these recrystallized grains and fine recrystallized grains already formed in the hot-rolled steel sheet occupy the majority of the steel sheet, with the result that a microstructure composed of fine crystal grains is formed. If this sheet, which has passed through the hot-rolled sheet, is cold-rolled and recrystallized, since the grain diameter before the cold rolling is fine, nucleation in {111}<112> becomes vigorous from the vicinity of the grain boundary while nucleation in {100}<025> from the interiors of grains is relatively reduced.

Accordingly, in the present invention, by the recrystallization subsequent to the final pass of the hot rolling, many low-strain recrystallized grains are formed in the hot-rolled steel sheet, and the diameter of the crystal grains is reduced. This influence is taken over after the subsequent hot-rolled sheet annealing, cold rolling and decarburization annealing, and in the decarburized sheet, the number of {111}<112> oriented grains advantageous for the growth of {110}<001> oriented grains is increased without any influence on the {110}<001> oriented grains while the number of {100}<025> oriented grains inhibiting the growth of {110}<001> oriented grains is reduced. Due to this characteristic feature, good magnetic properties can be stably obtained according to the present invention.

The method of the holding treatment conducted after termination of the hot rolling (hereinafter referred to as "cooling step-adjusting method") will now be described in detail with reference to the experimental results.

Figure 6:
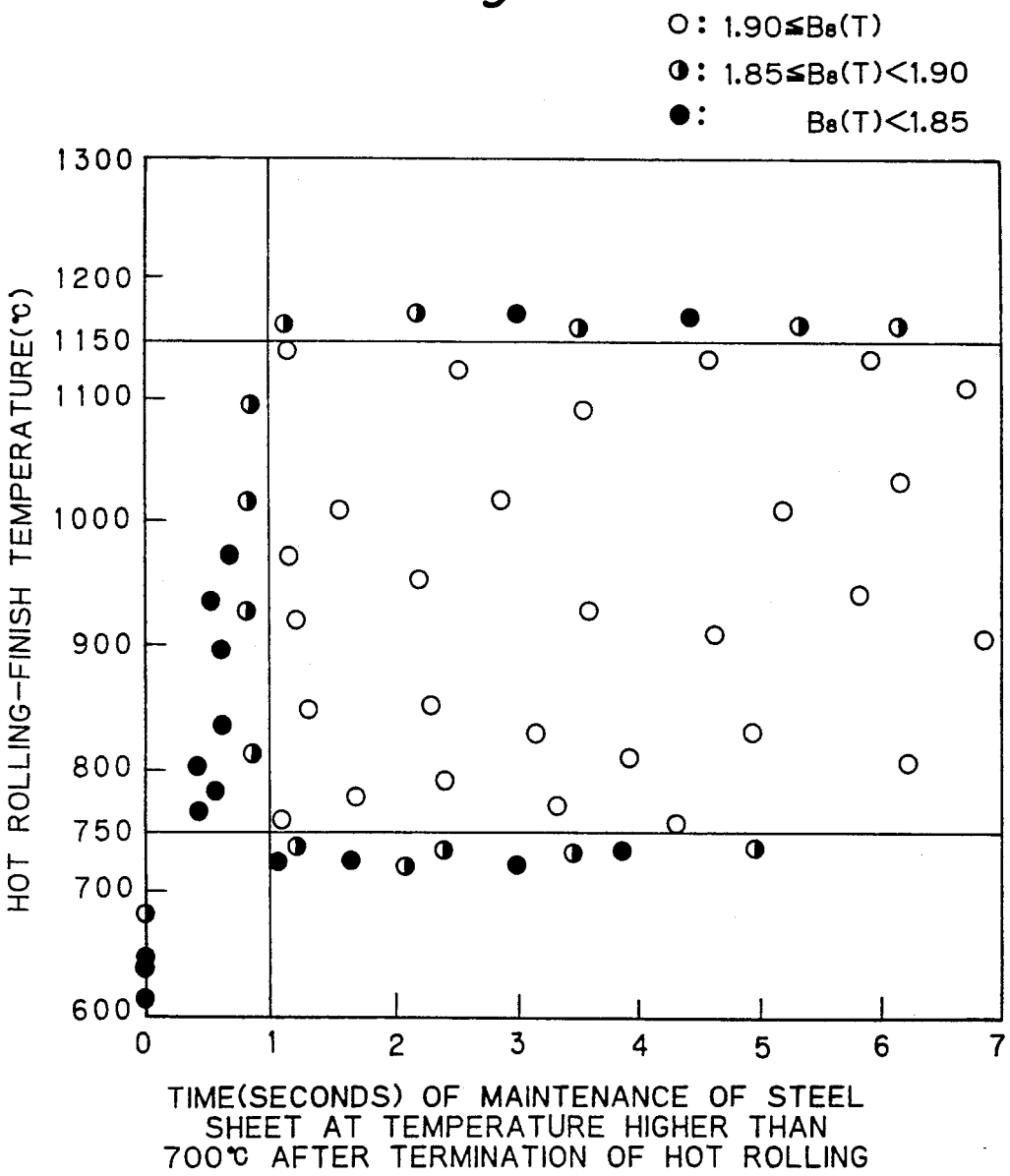
FIG. 6 is a graph illustrating the influences of the hot rolling-terminating temperature and the time of maintenance of the steel sheet at a temperature not lower than 700° C., after termination of the hot rolling, on the magnetic flux density of a product.

FIG. 6 is a graph illustrating the influences of the hot rolling-terminating temperature and the time of maintenance of the steel sheet at a temperature not lower than 700° C. after the hot rolling on the magnetic flux density. Namely, slabs having a thickness of 20 to 60 mm and comprising 0.055% by weight of C, 3.25% by weight of Si, 0.027% by weight of acid-soluble Al, 0.0078% by weight of N, 0.007% by weight of S and 0.14% by weight of Mn, with the balance consisting of iron and unavoidable impurities, were heated at 1100° to 1280° C. and hot-rolled to hot-rolled sheets having a thickness of 2.3 mm through 6 passes. Immediately, the hot-rolled sheets were water-cooled, air-cooled for a certain time, then subjected to various coolings such as water cooling and air cooling, and cooling was completed at 550° C., the sheets were maintained at 550° C. for 1 hour, and furnace cooling was carried out to effect a winding simulation. Then the hot-rolled sheets were subjected to the hot-rolled sheet annealing by maintaining them at a temperature of 900° to 1120° C. and the sheets were subjected to final high-reduction rolling at a reduction of about 88% to obtain cold-rolled steel sheets having a final thickness of 0.285 mm. Thereafter, decarburization annealing was carried out at a temperature of 830° to 1000° C., and subsequently, an anneal separating agent was coated on the sheets and the final finish annealing was carried out.

As apparent from FIG. 6, where the hot rolling-terminating temperature was 750° to 1150° C. and the steel sheet was maintained at a temperature higher than 700° C. for at least 1 second after termination of the hot rolling, a high magnetic flux density of $B_8 \geqq 1.90T$ was obtained.

Figure 7:
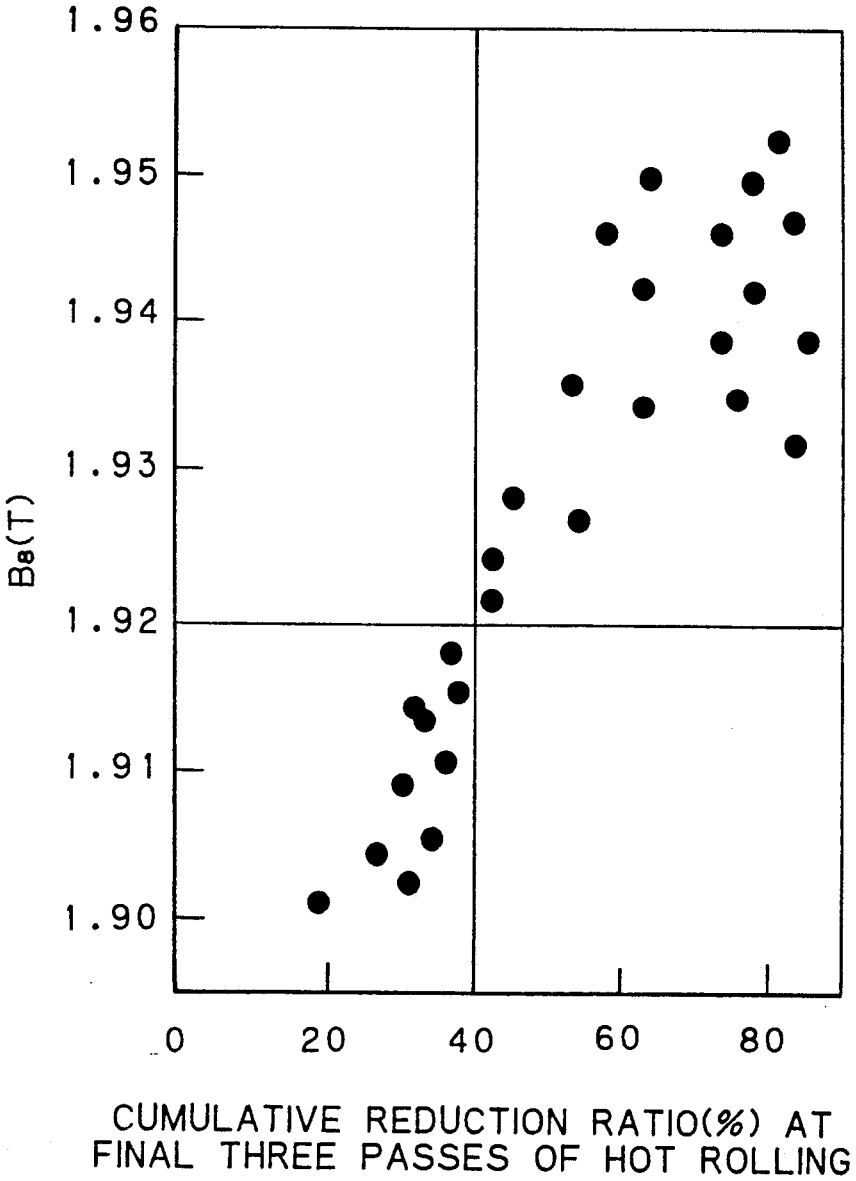
FIG. 7 is a graph illustrating the influences of the cumulative reduction ratio at the final three passes of the finish hot rolling, on the magnetic flux density of a product.

FIG. 7 is a graph illustrating the relationship between the cumulative reduction ratio at the final three passes of the finish hot rolling and the magnetic flux density, observed in runs giving a high magnetic flux density in FIG. 6, where the hot rolling-terminating temperature was 750° to 1150° C. and the steel sheet was maintained at a temperature not lower than 700° C. for at least 1 second after termination of the hot rolling.

As apparent from FIG. 7, where the cumulative reduction ratio at the final three passes of the finish hot rolling was at least 40%, a high magnetic flux density of $B_8 \geqq 1.92T$ was obtained.

Figure 8:
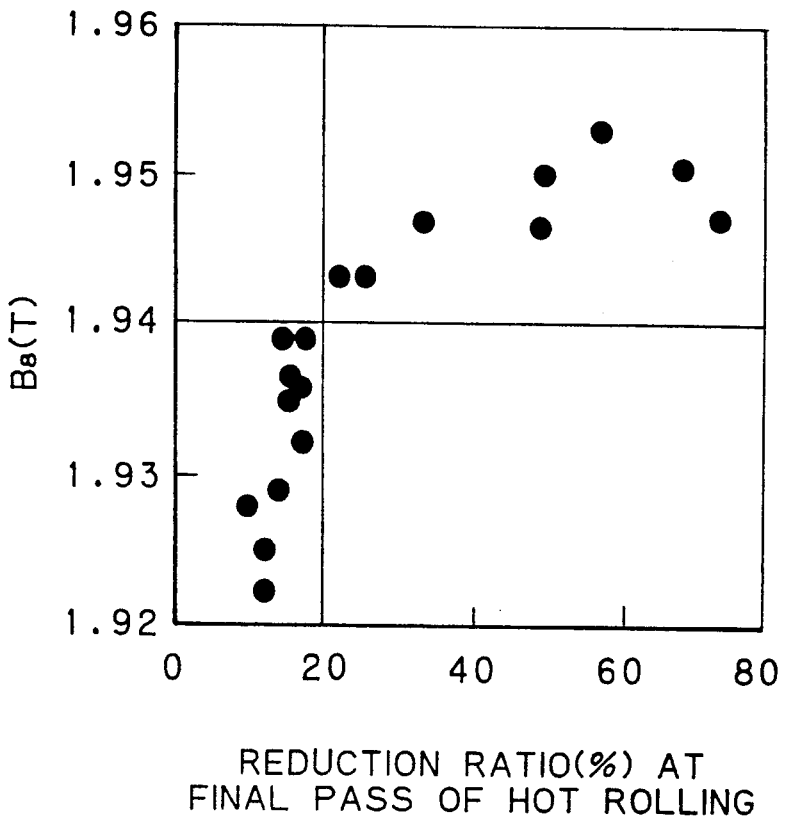
FIG. 8 is a graph illustrating the influences of the reduction ratio at the final pass of the finish hot rolling, on the magnetic flux density of a product.

FIG. 8 is a graph illustrating the relationship between the reduction ratio at the final pass of the finish hot rolling and the magnetic flux density, observed in runs giving a high magnetic flux density in FIG. 7, where the hot rolling-terminating temperature was 750° to 1150° C., the steel sheet was maintained at a temperature not lower than 700° C. for at least 1 second after termination of the hot rolling and the cumulative reduction ratio at the final three passes of the finish hot rolling was at least 40%.

As apparent from FIG. 8, where the reduction ratio at the final pass of the finish hot rolling was at least 20%, a high magnetic flux density of $B_8 \geqq 1.94T$ was obtained.

The reasons why the relationships shown in FIGS. 6, 7, and 8 are established among the hot rolling-terminating temperature, the time of maintenance of the steel sheet at a temperature not lower than 700° C. after the hot rolling, the cumulative reduction ratio at the final three passes of the finish hot rolling, the reduction ratio at the final pass of the finish hot rolling and the magnetic flux density of a product are not completely elucidated, but it is assumed that they are probably as follows.

Figure 9A:
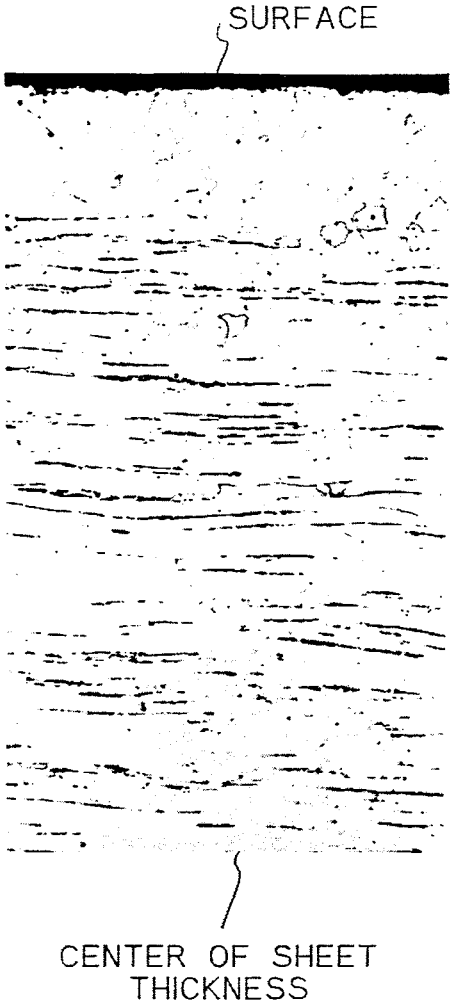
FIGS. 9-(*a*) and 9-(*b*) are metal microscope photos showing examples of microstructures and recrystallization ratios of hot-rolled sheets obtained under different hot rolling conditions (C) and (D), respectively.
Figure 9B:
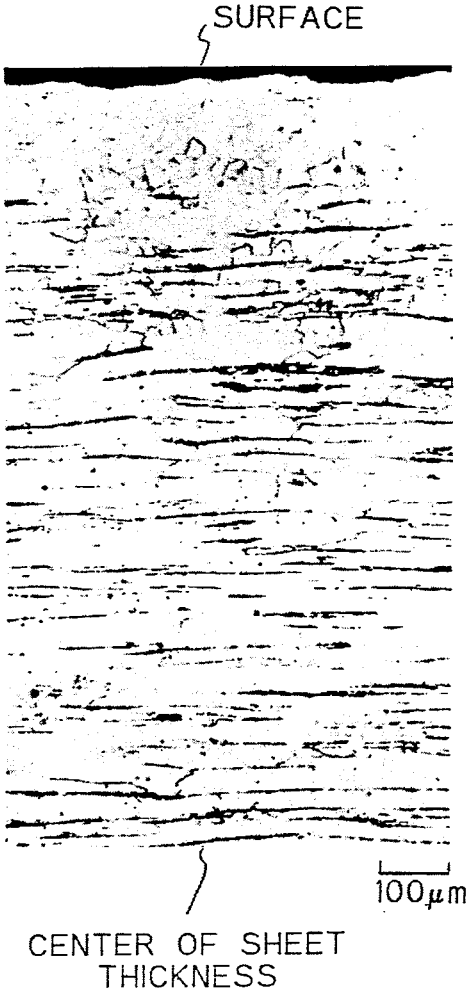

FIGS. 9-(*a*) and 9-(*b*) illustrate examples of hot-rolled microstructures and recrystallization ratios (at the point of ¼ thickness) obtained under different hot rolling conditions. Namely, slabs having a thickness of 26 mm and the same composition as described above with reference to FIG. 6 were heated at 1150° C., hot rolling was started at 1000° C., and the slabs were hot-rolled according to a pass schedule of 26 mm→11.8 mm→6.7 mm 3.5 mm→3.0 mm→2.6 mm→2.3 mm. The hot-rolled sheets were air-cooled for (C) 6 seconds or (D) 0.2 second, water-cooled to 550° C. at a rate of 200° C./sec, maintained at 550° C. for 1 hour, and subjected to furnace cooling to effect a winding simulation and obtain hot-rolled sheets having a thickness of 2.3 mm.

The hot rolling-terminating temperature was 846° C. and the time of maintenance of the steel sheet at a temperature higher than 700° C. was 6 seconds in the case of (C) or 0.9 second in the case of (D). The recrystallization ratios (at the point of ¼ thickness) of the hot-rolled sheets were measured by the same measurement method as described above with reference to FIGS. 3 and 4.

As apparent from FIG. 9, in runs (C) satisfying the conditions of the present invention, the recrystallization ratio (the area ratio of low-strain grains) of the hot-rolled sheet was high.

It has been considered that the matrix of {110}<001> secondary recrystallized crystal grains is formed by shearing deformation on the surface layer at the hot rolling, and that the method of coarsening the {110}<001> oriented crystal grains and keeping them in the strain-reduced state in the hot-rolled steel sheet is effective for enriching the {110}<001> oriented grains in the steel sheet after cold rolling and recrystallization.

Figure 10A:
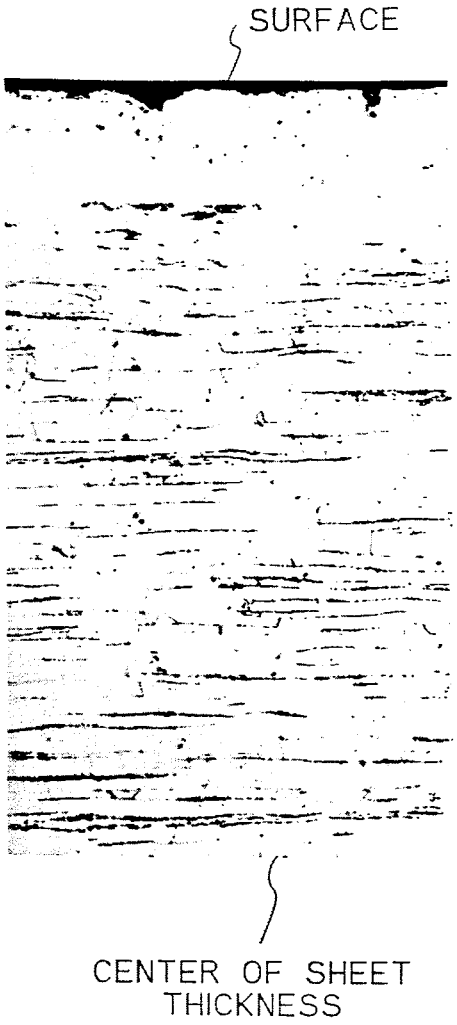
FIGS. 10-(*a*) and 10-(*b*) are metal microscope photos showing examples of microstructures and recrystallization ratios of hot-rolled sheets obtained under different hot rolling conditions (E) and (F), respectively.
Figure 10B:
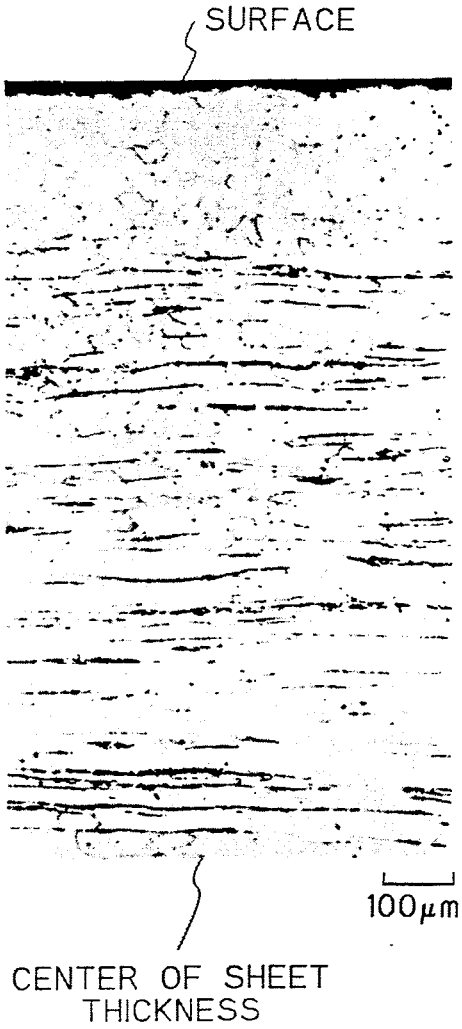

FIGS. 10-(*a*), 10-(*b*), 11-(*a*), 11-(*b*) and 12 show examples of microstructures and recrystallization ratios (at the point of ¼ thickness) of hot-rolled sheets obtained under different hot rolling conditions, microstructures after the hot-rolled sheet annealing and textures (at the point of ¼ thickness) after the decarburization annealing (decarburized sheets). Namely, slabs having a thickness of 26 mm and the same composition as described above with reference to FIG. 6 were heated at 1150° C., and the hot rolling was started at 1050° C. and carried out according to a pass schedule (E) 26 mm→20.6 mm→16.4 mm→13.0 mm→9.2 mm→4.6 mm→2.3 mm or (F) 26 mm→11.8 mm→6.7 mm→3.5 mm→3.0 mm→2.6 mm→2.3 mm. Then the hot-rolled sheets were air-cooled for 2 seconds, water-cooled to 550° C. at a rate of 100° C./sec, maintained at 550° C. for 1 hour, and subjected to furnace cooling to effect a winding simulation, whereby hot-rolled steel sheets having a thickness of 2.3 mm were obtained. The hot rolling-terminating temperature was (E) 930° C. or (F) 916° C., and the time of maintenance of the sheet at a temperature not lower than 700° C. was (E) 4 seconds or (F) 4 seconds. The hot-rolled steel sheets were maintained at 1120° C. for 30 seconds and maintained at 900° C. for 30 seconds, and then rapid cooling was carried out to effect the hot-rolled sheet annealing. The high-reduction rolling was then carried out at a reduction ratio of about 88% to obtain cold-rolled sheets having a final thickness of 0.285 mm, and the cold-rolled sheets were maintained at 840° C. for 150 seconds in an atmosphere comprising 25% of $N_2$ and 75% of $H_2$ and having a dew point of 60° C., to effect the decarburization annealing.

Figure 11A:
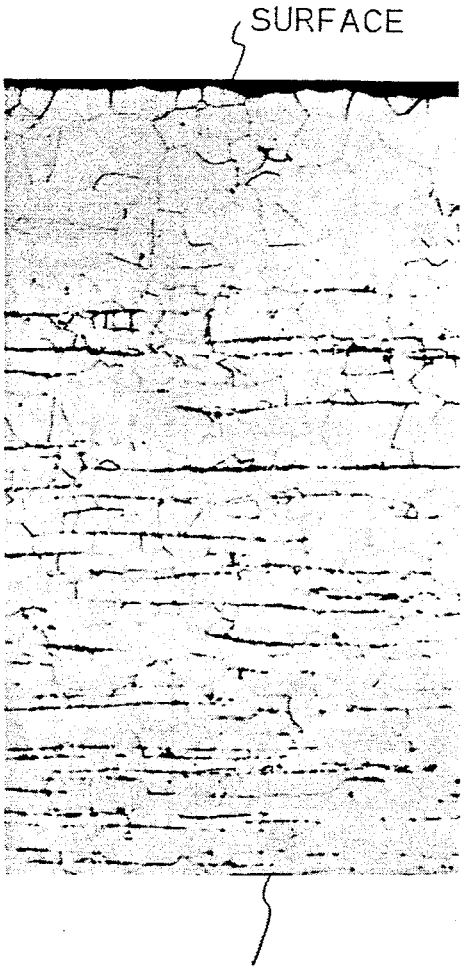
FIG. 11 is a metal microscope photo showing examples of microstructures of annealed sheets obtained under different hot rolling conditions.
Figure 11B:
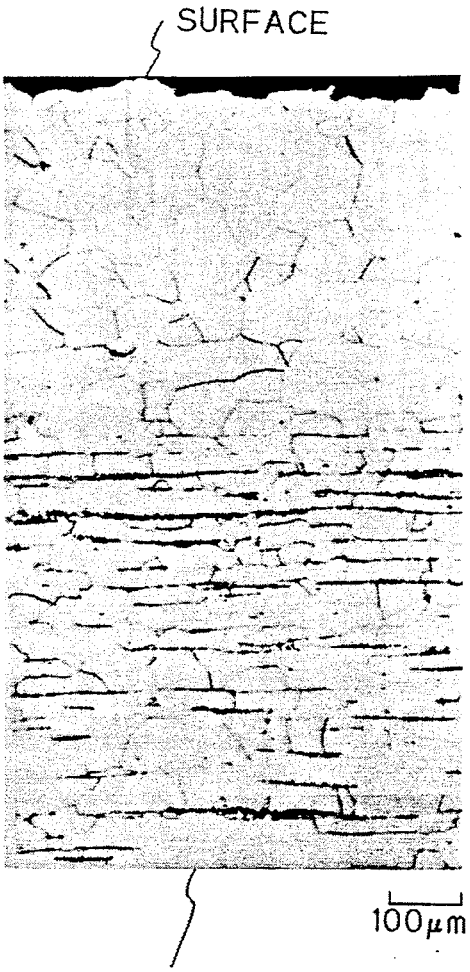
Figure 12:
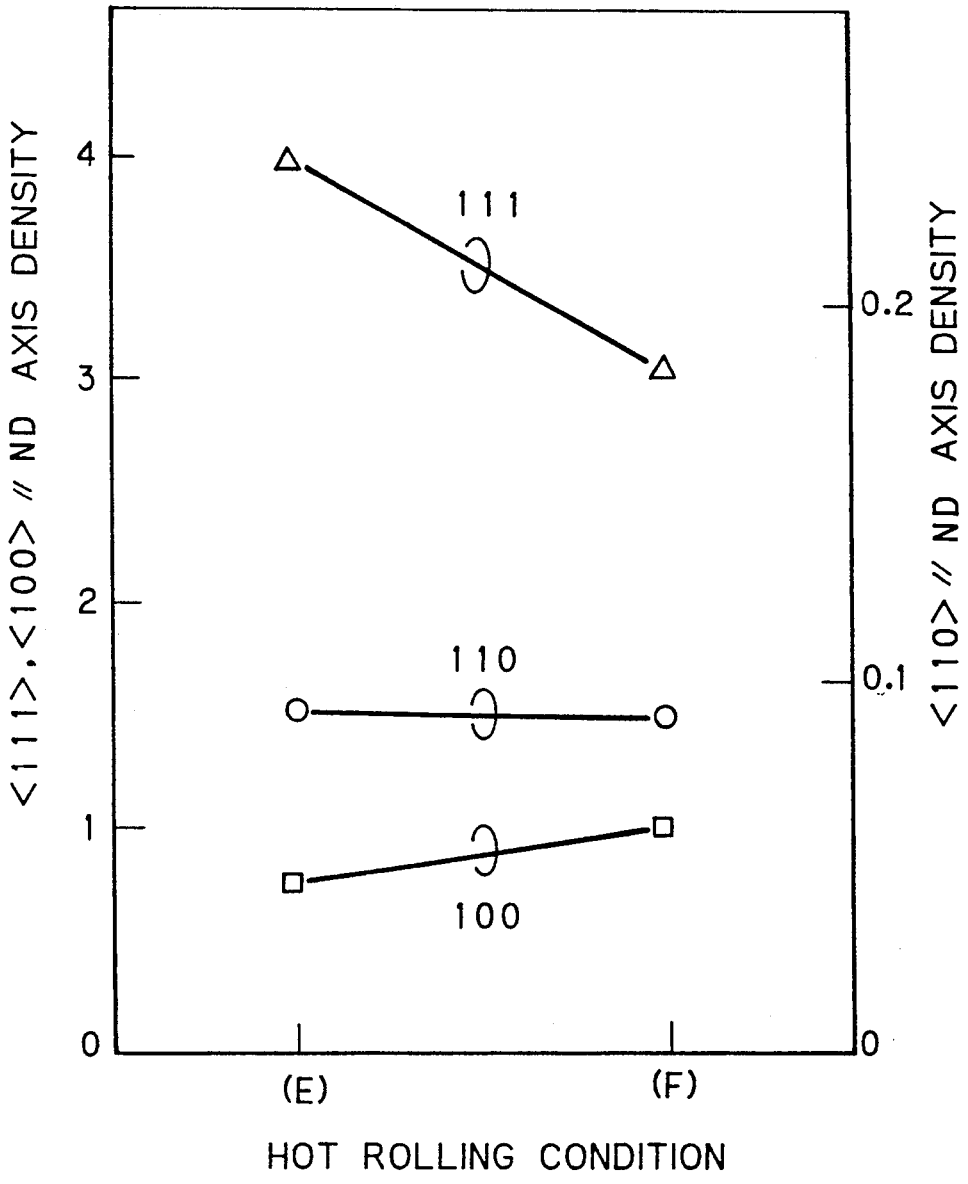
FIG. 12 is a graph showing examples of textures of decarburized sheets obtained under different hot rolling conditions (E) and (F), respectively.

As apparent from FIGS. 10-(*a*) and 10-(*b*), under conditions (E) where the cumulative reduction ratio at the final three passes was 82% and the reduction ratio at the final pass was 50%, the crystallization ratio of the hot-rolled sheet was much higher and the crystal grain diameter was smaller than under conditions (F) where the cumulative reduction ratio at the final three passes was 34% and the reduction ratio at the final pass was 12%. As apparent from FIGS. 11-(*a*) and 11-(*b*), in runs (E) satisfying the conditions of the present invention, the crystal grain diameter after the hot-rolled sheet annealing was finer than in comparative runs (F). Furthermore, as apparent from FIG. 12, under conditions (E), the number of {111} oriented grains in the decarburized sheet was larger and the number of {100} oriented grains was smaller than under conditions (F), and there was no substantial difference in the number of {110} oriented grains.

Under conditions (E), the crystal grain diameter of the hot-rolled sheet was small but the strain was reduced. This state was taken over after the hot-rolled sheet annealing and the number of {110}<001> oriented grains was increased after the cold rolling and recrystallization. Accordingly, this state had a disadvantageous grain diameter but advantageous strain, and consequently, after the decarburization and annealing, the number of {110}<001> oriented grains in the steel sheet was not influenced by the present invention hot-rolling method.

It is known that the main orientations {111}<112> and {100}<025> in the decarburized steel sheet are orientations having influences on the growth of {110}<001> secondary recrystallized crystal grains, and it is considered that the larger the number of {111}<112> oriented grains and the smaller the number of oriented grains, the easier the growth of {110}<001> secondary recrystallized grains. In the present invention, by applying a high reduction at the final three passes of the hot rolling, the number of sites for a formation of nuclei at the recrystallization subsequent to the final pass is increased, the recrystallization is advanced, and the crystal grains are made finer.

If this hot-rolled steel sheet is subjected to the hot-rolled sheet annealing, many nuclei present in the hot-rolled sheet are changed to recrystallized grains, and these recrystallized grains and fine recrystallized grains already formed in the hot-rolled steel sheet occupy the majority of the steel sheet, with the result that a microstructure composed of fine crystal grains is formed. If this sheet which has passed through the hot-rolled sheet is cold-rolled and recrystallized, since the grain diameter before the cold rolling is fine, nucleation in {111}<112> becomes vigorous from the vicinity of the grain boundary while nucleation in {100}<025> from the interiors of grains is relatively reduced.

Accordingly, in the present invention, by the recrystallization subsequent to the final pass of the hot rolling, many low-strain recrystallized grains are formed in the hot-rolled steel sheet, and the diameter of the crystal grains is reduced. This influence is taken over after the subsequent hot-rolled sheet annealing, cold rolling and decarburization annealing, and in the decarburized sheet, the number of {111}<112> oriented grains advantageous for the growth of {110}<001> oriented grains is increased without any influence on the {110}<001> oriented grains while the number of {100}<025> oriented grains inhibiting the growth of {110}<001> oriented grains is decreased.

In this cooling step-adjusting method, by maintaining the steel sheet at a high temperature after the final pass of the hot rolling, the recrystallization is advanced. Therefore, there can be obtained magnetic properties superior to the magnetic properties obtained according to the above-mentioned reduction ratio-adjusting method.

The reasons for the limitations of constructural requirements in the present invention will now be described.

First the reasons for the limitations of the contents of components of the slab used in the present invention and the slab-heating temperature will be described in detail.

If the C (carbon) content is lower than 0.021% by weight (all of "%" given hereinafter are by weight unless otherwise indicated), the secondary recrystallization becomes unstable, and even if the secondary recrystallization occurs, it is difficult to obtain the magnetic flux density of $B_8 > 1.80T$. Accordingly, the lower limit of the C content is set as at least 0.021% in the present invention. If the C content is too high, the decarburization time becomes too long and the process is disadvantageous from the economical point of view. Therefore, the upper limit of the C content is set as 0.075%.

If the Si content is higher than 4.5% cracking becomes conspicuous at the cold rolling, and thus the upper limit of the Si content is 4.5%. If the Si content is lower than 2.5%, the resistivity of the material is too low and a core loss required for a core material of a transformer cannot be obtained. Accordingly, in the present invention, the Si content is at least 2.5%, preferably at least 3.2%.

Al should be contained in an amount of at least 0.01% as acid-soluble Al, to ensure the AlN or (Al, Si) nitride content necessary for a stabilization of the secondary recrystallization. If the acid-soluble Al content exceeds 0.060%, the content of AlN in the hot-rolled sheet is not correct, and the secondary recrystallization becomes unstable. Accordingly, the upper limit of the acid-soluble Al content is set as 0.060%.

In a usual steel-making operation, it is difficult to control the N content to less than 0.0030%, and such a low N content is not preferred from the economical viewpoint. Accordingly, the lower limit of the N content is set as 0.0030%. If the N content exceeds 0.0130%, blistering of the surface of the steel sheet occurs, and therefore, the upper limit of the N content is set as 0.0130%.

Even if MnS and MnSe are present in the steel, it is possible to obtain good magnetic properties by selecting appropriate preparation conditions, but if the S or Se content is high, a tendency toward a formation of a region of insufficient secondary recrystallization called a "linear fine grain" occurs. To prevent the formation of this region of secondary recrystallization, preferably the requirement of $(S+0.405Se) \leqq 0.014\%$ is satisfied. If the S or Se content exceeds this range, the probability of the formation of the region of insufficient secondary recrystallization is increased, however controlled the preparation conditions may be, and good results cannot be obtained. Furthermore, in this case, the time required for purification at the final finish annealing becomes too long. In view of the foregoing, there is little or no significance to an unnecessary increase of the S or Se content.

The lower limit of the Mn content is 0.05%. If the Mn content is lower than 0.05%, the shape (flatness) of the hot-rolled sheet obtained by the hot rolling, especially the side edge of the strip, becomes wavy, and the problem of a reduction of the yield of the product arises. To obtain a good forsterite film, preferably the Mn content is not lower than $[0.05+7(S+0.405Se)]\%$. In the $MgO.SiO_2$ solid phase reaction, i.e., the forsterite film-forming reaction, MnO exerts a catalytic function, and therefore, to secure the necessary quantity of the activity of Mn in the steel, Mn must be present in an amount larger than the amount necessary for trapping S or Se in the form of MnS or MnSe. If the Mn content is lower than $[0.05+7(S+0.405Se)]\%$, the crystal grain diameter of forsterite becomes large and the adhesion of the film becomes poor. Therefore, the lower limit of the Mn content is preferably $[0.05+7(S+0.405Se)]\%$. If the Mn content exceeds 0.8%, the magnetic flux density of the product is reduced.

To reduce the manufacturing cost to the level of usual steels, the slab-heating temperature is limited to a level lower than 1280° C., preferably 1200° C. or less.

The heated slab is then hot-rolled to obtain a hot-rolled steel sheet. The characteristic features of the present invention reside in the hot rolling step. Namely, in the present invention, the hot rolling-terminating temperature is adjusted to 700° to 1150° C. and the cumulative reduction ratio at final three passes is adjusted to at least 40%. Furthermore, to obtain better magnetic properties, preferably the reduction ratio at the final pass is at least 20%.

Another characteristic feature of the present invention resides in the adjustment of the cooling step. Namely, the hot rolling finish temperature is adjusted to 750° to 1150° C., the hot-rolled sheet is maintained at a temperature not lower than 700° C. for at least 1 second after termination of the hot rolling and the winding temperature is adjusted to a level lower than 700° C. To obtain further improved magnetic properties, preferably the above-mentioned rolling conditions is satisfied as well as this condition of the adjustment of the cooling step, i.e., the cumulative reduction ratio at final three passes of the finish hot rolling is adjusted to at least 40%. Still further, to obtain much better magnetic properties, preferably the reduction ratio at the final pass is at least 20%.

In the present invention, the hot rolling step comprises, in general, rough rolling of a heated slab having a thickness of 100 to 400 mm through a plurality of passes and finish rolling through a plurality of passes. The rough rolling method is not particularly critical and can be performed according to customary procedures. The present invention is characterized by the finish rolling conducted after the rough rolling. The finish rolling is generally carried out by a high-speed continuous rolling of 4 to 10 passes. Usually, the reduction ratio is distributed so that the reduction ratio is high at the former stage and the reduction ratio is gradually decreased at the latter stage, whereby a good shape is obtained. The rolling speed is usually 100 to 3000 m/min and the time between two adjacent passes is 0.01 to 100 seconds. In the present invention, the hot rolling-terminating temperature, the cumulative reduction ratio at the final three passes and the reduction ratio at the final pass are restricted as the rolling conditions, and other conditions are not particularly critical, but if the time between two passes at the final three passes is extraordinarily long and exceeds 1000 seconds, the strain is relieved by a recovery and recrystallization between passes, and the effect of accumulation of the strain is not substantially obtained. Therefore, too long a time between two passes at the final three passes is not preferred. The reduction ratio at several passes of the former stage of the finish hot rolling is not particularly specified because it is not expected that the strain applied at these passes will be left at the final pass, and it is sufficient if only the reduction ratio at the final three passes is taken into consideration.

The reasons for the limitations of the hot rolling conditions will now be described.

The reasons for limiting the hot rolling-finish temperature 700° to 1150° C. and the cumulative reduction ratio at the final three passes to 40% are as described below. As apparent from FIG. 1, if these conditions are satisfied, a product having a good magnetic flux density $B_8$ of $B_8 \geqq 1.90T$ can be obtained. The upper limit of the cumulative reduction ratio at the final three passes is not particularly critical, but it is industrially difficult to apply a cumulative reduction ratio higher than 99.9%. In the present invention, most preferably the reduction ratio at the final pass is at least 20%. As seen from FIG. 2, if this requirement is satisfied, a product having a better magnetic flux density $B_8$ of $B_8 \geqq 1.92T$ can be obtained. The upper limit of the reduction ratio at the final pass is not particularly critical, but it is industrially difficult to apply a reduction ratio exceeding 90%.

The reasons for the limitations of treatment conditions of the cooling step conducted after the hot rolling in the present invention will now be described. The reason why the hot rolling finish temperature is adjusted to 750° to 1150° C. and the hot-rolled sheet is maintained at a temperature not lower than 700° C. for at least 1 second is that, as seen from FIG. 6, if these requirements are satisfied, a product having a magnetic flux density $B_8$of $B_8 \geqq 1.90T$ is obtained. The upper limit of the time of maintenance of the sheet at a temperature not lower than 700° C. is not particularly critical, but since the time between the point of termination of the hot rolling and the point of initiation of the winding is usually about 0.1 to about 1000 seconds, in view of the equipment, it is difficult to maintain the steel sheet in the form of a strip at a temperature not lower than 700° C. for at least 1000 seconds.

If the winding temperature after the hot rolling is not lower than 700° C., because of the difference of the heat history in the coil at the cooling step, the state of precipitation of AlN or the like, the state of surface decarburization and the microstructure become irregular in the coil, resulting in a dispersion of the magnetic properties in the product. Therefore, the winding temperature must be lower than 700° C.

The reason why the cumulative reduction ratio at the final three passes of the finish hot rolling is limited to at least 40% in the cooling step-adjusting method is the same as described above with reference to the reduction ratio-adjusting method. Practically, as apparent from FIG. 7, if this requirement is satisfied, a product having a good magnetic flux density of $B_8 \geqq 1.92T$ is obtained.

The upper limit of the cumulative reduction ratio at the final three passes in the cooling step-adjusting method is not particularly critical, but it is industrially difficult to apply a cumulative reduction ratio higher than 99.9%. The reason why the reduction ratio at the final pass is preferably adjusted to at least 20% is that, as seen from FIG. 8, a product having a much better magnetic flux density of $B_8 \geqq 1.94T$ is obtained. The upper limit of the reduction ratio at the final pass is not particularly critical, but it is industrially difficult to apply a reduction ratio not lower than 90%.

The hot-rolled steel sheet prepared according to the above-mentioned process is subjected to the hot-rolled sheet annealing according to need, and at least one cold rolling including intermediate annealing, according to need, is carried out. The reason why the reduction ratio at the final cold rolling is adjusted to at least 80% is that, if this requirement is satisfied, appropriate amounts of sharp {110}<001> oriented grains and coincidence oriented grains [{111}<112> oriented grains, etc.] which is easily corroded by the above grains can be obtained, and the magnetic flux density is greatly improved.

After the cold rolling, the steel sheet is subjected to decarburization annealing, coating with an anneal separating agent, and finish annealing according to customary procedures to obtain a final product. Note, where the inhibitor intensity necessary for a secondary recrystallization is insufficient in the state after decarburization annealing, it is necessary to carry out an inhibitor-reinforcing treatment at the finish annealing or the like. As the inhibitor-reinforcing method, there is known, for example, a method in which, for an Al-containing steel, the partial pressure of nitrogen in the gas of the finish annealing atmosphere is set at a relatively high level.

The present invention will now be described in detail with reference to the following examples, that by no means limit the scope of the invention.

EXAMPLE 1

A slab having a thickness of 40 mm, which comprised 0.056% by weight of C, 3.28% by weight of Si, 0.14% by weight of Mn, 0.005% by weight of S, 0.029% by weight of acid-soluble Al and 0.0078% by weight of N, with the balance consisting of Fe and unavoidable impurities, was heated at 1150° C., the hot rolling was started at 1050° C., and the slab was hot-rolled through 6 passes to obtain a hot-rolled sheet having a thickness of 2.3 mm. The reduction ratio distribution adopted was (1) 40 mm→15 mm→7 mm→3.5 mm→3 mm→2.6 mm→2.3 mm, (2) 40 mm→30 mm→20 mm→10 mm→5 mm→2.8 mm→2.3 mm, or (3) 40 mm→30 mm→20 mm→10 mm→5 mm→3 mm→2.3 mm. After termination of the hot rolling, the hot-rolled sheet was subjected to a winding simulation where the sheet was air-cooled for 1 second, water-cooled to 550° C., maintained at 550° C. for 1 hour, and subjected to furnace cooling. Then the hot-rolled sheet was subject to hot-rolled sheet annealing where the sheet was maintained at 1120° C. for 30 seconds and at 900° C. for 30 seconds, and then rapidly cooled. Thereafter, the sheet was then rolled at a reduction ratio of about 88%, to obtain a cold-rolled sheet having a thickness of 0.285 mm, the cold-rolled sheet was maintained at 830° C. for 150 seconds to effect decarburization annealing, the obtained decarburized and annealed sheet was coated with an anneal separating agent composed mainly of MgO, and was subjected to final finish annealing wherein the temperature was elevated to 1200° C. at a rate of 10° C./hr in an atmosphere gas comprising 75% of $N_2$ and 25% of $H_2$, and the sheet was maintained at 1200° C. for 20 hours in an atmosphere gas comprising 100% of $H_2$.

The hot rolling condition, the hold rolling-terminating temperature, and the magnetic properties of the product are shown in Table 1.

TABLE 1

| Hot Rolling Condition | Hot Rolling-Finish Temperature (°C.) | Cumulative Reduction Ratio (%) at Final three Passes | Reduction Ratio (%) at Final Pass | $B_8$ (T) | Remarks |
|---|---|---|---|---|---|
| (1) | 881 | 34 | 12 | 1.88 | comparison |
| (2) | 914 | 77 | 18 | 1.91 | present invention |
| (3) | 927 | 77 | 23 | 1.93 | present invention |

EXAMPLE 2

A slab having a thickness of 26 mm, which comprised 0.053% by weight of C, 3.28% by weight of Si, 0.15% by weight of Mn, 0.006% by weight of S, 0.030% by weight of acid-soluble Al and 0.0081% by weight of N, with the balance consisting of Fe and unavoidable impurities, was heated at 1150° C. and the slab was hot-rolled through six passes to obtain a hot-rolled sheet having a thickness of 2.3 mm. The reduction ratio distribution adopted was 26 mm→15 mm→10 mm→7 mm→5 mm→2.8 mm→2.3 mm. The hot-rolling-starting temperature was (1) 1000° C., (2) 900° C., (3) 800° C. or (4) 700° C. The conditions of the cooling after the hot rolling and the step of up to the final finish annealing were the same as those of Example 1.

The hot rolling condition, the hot rolling-terminating temperature, and the magnetic properties of the product are shown in Table 2.

TABLE 2

| Hot Rolling Condition | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 904 | 67 | 18 | 1.91 | present invention |
| (2) | 832 | 67 | 18 | 1.91 | present invention |
| (3) | 743 | 67 | 18 | 1.90 | present invention |
| (4) | 665 | 67 | 18 | 1.88 | comparison |

EXAMPLE 3

A slab having a thickness of 40 mm, which comprised 0.051% by weight of C, 3.30% by weight of Si, 0.14% by weight of Mn, 0.006% by weight of S, 0.031% by weight of acid-soluble Al and 0.0082% by weight of N, with the balance consisting of Fe and unavoidable impurities, was heated at 1250° C. and the slab was hot-rolled through 6 passes to obtain a hot-rolled sheet having a thickness of 2.0 mm. The reduction ratio distribution adopted was 40 mm→30 mm→20 mm→10 mm→5 mm→3 mm→2 mm, and the hot rolling-initiating temperature was (1) 1250° C., (2) 1100° C. or (3) 1000° C. After the hot rolling, the hot-rolled sheet was cooled under the same conditions as adopted in Example 1. The hot-rolled sheet was maintained at 1120° C. for 30 seconds and at 900° C. for 30 minutes, and rapidly cooled to effect the hot-rolled sheet annealing. The sheet was then rolled at a reduction ratio of 89% to obtain a cold-rolled sheet having a thickness of 0.220 mm, maintained at 830° C. for 120 seconds and at 910° C. for 20 seconds to effect the decarburization annealing, and the obtained decarburized sheet was coated with an anneal separating agent composed mainly of MgO. The temperature was elevated to 880° C. at a rate of 10° C./hr in an atmosphere gas comprising 25% of $N_2$ and 75% of $H_2$, the temperature was elevated to 1200° C. at a rate of 15° C./hr in an atmosphere gas comprising 75% of $N_2$ and 25% of $H_2$, and the sheet was maintained at 1200° C. for 20 hours in an atmosphere gas comprising 100% of $H_2$ to effect the final finish annealing.

The hot rolling condition, the hot rolling-terminating temperature, and the magnetic properties of the product are shown in Table 3.

TABLE 3

| Hot Rolling Condition | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 1172 | 80 | 33 | 1.89 | comparison |
| (2) | 987 | 80 | 33 | 1.93 | present invention |
| (3) | 913 | 80 | 33 | 1.94 | present invention |

EXAMPLE 4

A slab having a thickness of 40 mm, which comprised 0.052% by weight of C, 3.21% by weight of Si, 0.14% by weight of Mn, 0.006% by weight of S, 0.030% by weight of acid-soluble Al and 0.0080% by weight of N, with the balance consisting of Fe and unavoidable impurities, was heated at 1150° C., and the hot rolling was started at 1050° C. and the slab was hot-rolled through 6 passes to obtain a hot-rolled sheet having a thickness of 1.6 mm. The reduction ratio distribution adopted was (1) 40 mm→ 16 mm→7 mm→2.6 mm→2.0 mm→1.8 mm→1.6 mm, (2) 40 mm→30 mm→20 mm→10 mm→5 mm→2.5 mm→1.6 mm, (3) 40 mm→30 mm→22 mm→12 mm→6 mm→3.1 mm→1.6 mm or (4) 40 mm→30 mm→20 mm→11 mm→4.5 mm→2.9 mm→1.6 mm. The cooling after the hot rolling was carried out under the same conditions as described in Example 1. The hot-rolled sheet was maintained at 1120° C. for 30 seconds and at 900° C. for 30 seconds to effect the hot-rolled sheet annealing, and the sheet was then rolled at a reduction ratio of 89% to obtain a cold-rolled sheet having a thickness of 0.170 mm. The operations up to the final finish annealing were carried out under the same conditions as described in Example 1.

The hot rolling condition, the hot rolling-terminating temperature, and the magnetic properties of the product are shown in Table 4.

TABLE 4

| Hot Rolling Condition | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 886 | 38 | 11 | 1.89 | comparison |
| (2) | 904 | 84 | 36 | 1.93 | present invention |
| (3) | 920 | 87 | 48 | 1.95 | present invention |
| (4) | 954 | 85 | 45 | 1.94 | present invention |

EXAMPLE 5

A slab having a thickness of 40 mm, which comprised 0.057% by weight of C, 3.23% by weight of Si, 0.15% by weight of Mn, 0.005% by weight of S, 0.028% by weight of acid-soluble Al and 0.0077% by weight of N, with the balance consisting of Fe and unavoidable impurities, was heated at 1150° C., and the hot rolling was started at 1000° C. and the slab was hot-rolled through a pass schedule of 40 mm→15 mm→7 mm→3.5 mm→3 mm→2.6 mm→2.3 mm. The hot rolling-terminating temperature was 854° C. The sheet was then subjected to (1) a winding simulation wherein the sheet was air-cooled (852° C.), water-cooled to 550° C. at a rate of 250° C./sec, maintained at 550° C. for 1 hour, and subjected to furnace cooling, or (2) a winding simulation where the sheet was air-cooled (804° C.), water-cooled to 550° C. at a rate of 100° C./sec, maintained at 550° C. for 1 hour, and subjected to furnace cooling. The hot-rolled sheet was maintained at 1050° C. for 30 seconds and at 900° C. for 30 seconds and then rapidly cooled to effect the hot-rolled sheet annealing. The sheet was then rolled at a reduction ratio of 88% to obtain a cold-rolled sheet having a thickness of 0.285 mm, was maintained at 830° C. for 150 seconds to effect the decarburization annealing, the decarburized sheet was coated with an anneal separating agent composed mainly of MgO, the temperature was elevated to 1200° C. at a rate of 10° C./hr in an atmosphere gas comprising 75% of $N_2$ and 25% of $H_2$, and the sheet was maintained at 1200° C. for 20 hours in an atmosphere gas comprising 100% of $H_2$ to effect the final finish annealing.

The rolling condition and the magnetic properties of the product are shown in Table 5.

TABLE 5

| Hot Rolling Condition | Hot Rolling-Finish Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|
| (1) | 854 | 0.8 | 550 | 34 | 12 | 1.89 | comparison |
| (2) | 854 | 6 | 550 | 34 | 12 | 1.91 | present invention |

EXAMPLE 6

A slab having a thickness of 26 mm, which comprised 0.053% by weight of C, 3.26% by weight of Si, 0.15% by weight of Mn, 0.007% by weight of S, 0.030% by weight of acid-soluble Al and 0.0081% by weight of N, with the balance consisting of Fe and unavoidable impurities, was heated at 1150° C., and the slab was hot-rolled through 6 passes to obtain a hot-rolled sheet having a thickness of 2.3 mm. The reduction ratio distribution adopted was 26 mm→15 mm→10 mm→7 mm→5 mm→2.8 mm→2.3 mm. The hot rolling-starting temperature was adjusted to (1) 1000° C., (2) 900° C., (3) 800° C. or (4) 700° C. After finishing the hot rolling, the sheet was subjected to a winding simulation where the sheet was air-cooled for 3 seconds, water-cooled to 550° C. at a rate of 100° C./sec, maintained at 550° C. for 1 hour, and subjected to the furnace cooling. Then the operations up to the final finish annealing were carried out under the same conditions as described in Example 5.

The hot rolling condition and the magnetic properties of the product are shown in Table 6.

TABLE 6

| Hot Rolling Condition | Hot Rolling-Finish Temperature (°C.) | Water Cooling-Finish Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 904 | 873 | 5 | 550 | 67 | 18 | 1.93 | present invention |
| (2) | 833 | 804 | 4 | 550 | 67 | 18 | 1.93 | present invention |
| (3) | 737 | 706 | 3 | 550 | 67 | 18 | 1.92 | present invention |

TABLE 6-continued

| Hot Rolling Condition | Hot Rolling-Finish Temperature (°C.) | Water Cooling-Finish Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (4) | 658 | 628 | 0 | 550 | 67 | 18 | 1.87 | comparison |

EXAMPLE 7

A slab having a thickness of 40 mm, which comprised 0.054% by weight of C, 3.27% by weight of Si, 0.14% by weight of Mn, 0.006% by weight of S, 0.029% by weight of acid-soluble Al and 0.0080% by weight of N, with the balance consisting of Fe and unavoidable impurities, was heated at 1150° C., and the hot rolling was started at 1000° C. and the slab was hot-rolled through a pass schedule of 40 mm→30 mm→20 mm→10 mm→5 mm→3 mm→2 mm. After finishing of the hot rolling, the sheet was subjected to cooling under such conditions that (1) the sheet was air-cooled for 2 seconds, water-cooled to 550° C. at a rate of 100° C./sec, maintained at 550° C. for 1 hour and subjected to the furnace cooling or (2) the sheet was air-cooled for 2 seconds, water-cooled to 750° C. at a rate of 50° C./sec, maintained at 750° C. for 1 hour, and subjected to the furnace cooling. Then the hot-rolled sheet was maintained at 1120° C. for 30 seconds and at 900° C. for 30 seconds and was rapidly cooled to effect the hot-rolled sheet annealing. The subsequent operations up to the final finish annealing were carried out in the same manner as described in Example 5.

The hot rolling condition and the magnetic properties of the product are shown in Table 7.

TABLE 7

| Hot Rolling Condition | Hot Rolling-Finish Temperature (°C.) | Water Cooling-Initiating Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 912 | 892 | 4 | 550 | 80 | 33 | 1.95 | present invention |
| (2) | 912 | 892 | 7205 | 750 | 80 | 33 | 1.89 | comparison |

EXAMPLE 8

A slab having a thickness of 40 mm, which comprised 0.053% by weight of C, 3.40% by weight of Si, 0.14% by weight of Mn, 0.006% by weight of S, 0.030% by weight of acid-soluble Al and 0.0080% by weight of N, with the balance consisting of Fe and unavoidable impurities, was heated at 1250° C. and hot-rolled through 6 passes to obtain a hot-rolled sheet having a thickness of 40 mm. The reduction ratio distribution adopted was 40 mm→30 mm→20 mm→10 mm→5 mm→3 mm→2 mm, and the hot rolling-initiating temperature was (1) 1250° C., (2) 1100° C. or (3) 1000° C. After the hot rolling, the sheet was cooled under the same conditions as described in Example 6. The hot-rolled sheet was maintained at 1120° C. for 30 seconds and at 900° C. for 30 seconds and was rapidly cooled to effect the hot-rolled sheet annealing. Then the sheet was cold-rolled at a reduction ratio of 89% to obtain a cold-rolled sheet having a thickness of 0.220 mm, the sheet was maintained at 830° C. for 120 seconds and at 900° C. for 20 seconds to effect the decarburization annealing, and the obtained decarburized sheet was coated with an anneal separating agent composed mainly of MgO. Then the temperature was elevated to 880° C. at a rate of 10° C./hr in an atmosphere gas comprising 25% of $N_2$ and 75% of $H_2$, the temperature was elevated to 1200° C. at a rate of 15° C./hr in an atmosphere gas comprising 75% of $N_2$ and 25% of $H_2$, and the sheet was maintained at 1200° C. for 20 hours in an atmosphere gas comprising 100% of $H_2$.

The hot rolling condition and the magnetic properties of the product are shown in Table 8.

TABLE 8

| Hot Rolling Condition | Hot Rolling-Finish Temperature (°C.) | Water Cooling-Initiating Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 1173 | 1143 | 7 | 550 | 80 | 33 | 1.83 | comparison |
| (2) | 987 | 956 | 6 | 550 | 80 | 33 | 1.94 | present invention |
| (3) | 912 | 880 | 5 | 550 | 80 | 33 | 1.95 | present invention |

EXAMPLE 9

A slab having a thickness of 40 mm, which comprised 0.052% by weight of C, 3.21% by weight of Si, 0.14% by weight of Mn, 0.006% by weight of S, 0.030% by weight of acid-soluble Al and 0.0080% by weight of N, with the balance consisting of Fe and unavoidable impurities, were heated at 1150° C., the hot rolling was started at 1050° C., and the sheet was hot-rolled through 6 passes to obtain a hot-rolled sheet having a thickness of 1.6 mm. The reduction ratio distribution adopted was (1) 40 mm→16 mm→7 mm→2.6 mm→2.0 mm→1.8 mm→1.6 mm, (2) 40 mm→30 mm→20 mm→10 mm→5 mm→2.5 mm→1.6 mm, (3) 40 mm→30 mm→22 mm→12 mm→6 mm→3.1 mm→1.6 mm or (4) 40 mm→30 mm→20 mm→11 mm→4.5 mm→2.9 mm→1.6 mm. The cooling after the hot rolling was carried out under the same conditions as described in Example 6. The hot-rolled sheet was maintained at 1120° C. for 30 seconds and at 900° C. for 30 seconds to effect the hot-rolled sheet annealing. The sheet was rolled at a reduction ratio of about 89% to obtain a cold-rolled sheet having a thickness of 0.170 mm, and the subsequent operations up to the final finish annealing were carried out under the same conditions as described in Example 5.

The hot rolling condition and the magnetic properties of the product are shown in Table 9.

TABLE 9

| Hot Rolling Condition | Hot Rolling-Finish Temperature (°C.) | Water Cooling-Initiating Temperature (°C.) | Time (sec) of Maintenance not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 885 | 854 | 5 | 550 | 38 | 11 | 1.91 | present invention |
| (2) | 905 | 873 | 5 | 550 | 84 | 36 | 1.94 | present invention |
| (3) | 921 | 890 | 5 | 550 | 87 | 48 | 1.95 | present invention |
| (4) | 953 | 921 | 5 | 550 | 85 | 45 | 1.95 | present invention |

We claim:

1. A process for the production of a grain-oriented electrical steel sheet which comprises: heating at a temperature lower than 1280° C. a slab comprising 0.021 to 0.075% by weight of C, 2.5 to 4.5% by weight of Si, 0.010 to 0.060% by weight of acid-soluble Al, 0.0030 to 0.0130% by weight of N, up to 0.014% by weight of S+0.405 Se and 0.05 to 0.8% by weight of Mn, with the balance being Fe and unavoidable impurities, hot-rolling the slab to provide a hot rolled sheet, wherein the hot rolling comprises a rough rolling and a finish rolling having at least three passes, with a hot rolling finish temperature of 700° to 1150° C. and with a cumulative reduction ratio of the final three hot rolling passes of at least 40%, subjecting the hot rolled sheet to annealing at a temperature of 1050° C. to 1120° C., after said annealing, subjecting the hot-rolled and annealed steel sheet to at least one cold rolling including final cold rolling at a reduction ratio of at least 80%, and subjecting the cold-rolled sheet to decarburization annealing the final finish annealing.

2. A process according to claim 1, wherein the reduction ratio at the final pass of the finish hot rolling is adjusted to at least 20%.

3. A process for the production of a grain-oriented electrical steel sheet which comprises: heating at a temperature lower than 1280° C. a slab comprising 0.021 to 0.075% by weight of C, 2.5 to 4.5% by weight of Si, 0.010 to 0.060% by weight of acid-soluble Al, 0.0030 to 0.0130% by weight of N, up to 0.014% by weight of S+0.405 Se and 0.05 to 0.8% by weight of Mn, with the balance being Fe and unavoidable impurities, hot-rolling the slab to provide a hot rolled sheet, wherein the hot rolling comprises a rough rolling and a finish rolling having at least three passes with a hot rolling finish temperature of 750° to 1150° C., the hot rolled sheet is held at a temperature of not lower than 700° C. for at least 1 second after termination of hot rolling, followed by winding of the hot rolled sheet at a winding temperature of less than 700° C., subjecting the hot rolled sheet to annealing at a temperature of 1050° C. to 1120° C., after said annealing, subjecting the hot rolled and annealed steel sheet to at least one cold rolling including final cold rolling at a reduction ratio of at least 80%, and subjecting the cold-rolled sheet to decarburization annealing the final finish annealing.

4. A process according to claim 3, wherein the hot finish rolling comprises at least three passes, with a cumulative reduction ratio at the final three passes being at least 40%.

5. A process according to claim 3, wherein the reduction ratio at the final pass of the finish hot rolling is at least 20%.

6. A process according to claim 1 or 3 which includes more than one cold rolling and which further includes an intermediate annealing between each successive cold rolling.

* * * * *

UNITED STATES PATENT AND TRADEMARK OFFICE

CERTIFICATE OF CORRECTION

PATENT NO. : 5,261,971
DATED : November 16, 1993
INVENTOR(S) : Yoshitomi, et. al.

It is certified that error appears in the above-indentified patent and that said Letters Patent is hereby corrected as shown below:

Column 21, claim 1, line 50, delete "the" and insert --and--.

Column 22, claim 3, line 30, delete "the" and insert --and--.

Signed and Sealed this

Thirtieth Day of August, 1994

*Attest:*

*Attesting Officer*

BRUCE LEHMAN

*Commissioner of Patents and Trademarks*